US006632186B2

(12) United States Patent
Tsai

(10) Patent No.: US 6,632,186 B2
(45) Date of Patent: Oct. 14, 2003

(54) MASSAGING DEVICE FOR ELIMINATING FAT

(76) Inventor: Ching Hsiung Tsai, PO Box 82-144, Taipei (TW)

( * ) Notice: Subject to any disclaimer, the term of this patent is extended or adjusted under 35 U.S.C. 154(b) by 3 days.

(21) Appl. No.: 09/886,095

(22) Filed: Jun. 22, 2001

(65) Prior Publication Data

US 2002/0198478 A1 Dec. 26, 2002

(51) Int. Cl.[7] ..... A61H 15/00
(52) U.S. Cl. ..... 601/112; 601/85; 601/87
(58) Field of Search ..... 601/112, 113, 601/116, 118, 119, 122, 123, 126, 127, 46, 85, 87

(56) References Cited

U.S. PATENT DOCUMENTS 2,384,427 A * 9/1945 Andis ..... 601/125
4,526,163 A * 7/1985 Fedders ..... 601/112
5,356,369 A * 10/1994 Yamasaki et al. ..... 601/113
5,415,621 A * 5/1995 Campbell ..... 601/112
5,662,593 A * 9/1997 Tillman et al. ..... 601/113
6,402,710 B1 * 6/2002 Hsu ..... 601/112

* cited by examiner

*Primary Examiner*—Justine R. Yu
(74) *Attorney, Agent, or Firm*—Leong C. Lei

(57) ABSTRACT

A massaging device to eliminate fat on a human body is disclosed. The massaging device comprises a substantially T-shaped hold boy, a rotating motor, a bowl-shaped seat body, a massaging wheel seat, and a netlike cap. The massaging wheel is in contact with the human body so as to massage the body. A controller is provided at an appropriate section of the power source cable of the device, facilitating the user to control the power supply of the massaging device.

1 Claim, 4 Drawing Sheets

MASSAGING DEVICE FOR ELIMINATING FAT

BACKGROUND OF THE INVENTION (a) Field of the Invention

The present invention relates to a massaging device, and in particular, a massaging device for eliminating fat in a human body.

(b) Description of the Prior Art

Massaging device is frequently used to provide massaging to a human body. Massaging is an effective way to relieve muscle strain and to provide blood circulation. A conventional type of massaging device comprises a motor means including means, which entrain inner rollers in rotation. The main disadvantage of this conventional massaging device is that the structure is complicated and the cost is expensive.

A conventional electrical massaging chair has been introduced and is used to have every part of body be massaged. This massaging chair only provides massaging to some inaccessible parts of the body but it cannot apply a massage to the body part you wish to massage. Furthermore, it is not portable and is not affordable to the poor families.

SUMMARY OF THE INVENTION

Accordingly, it is an object of the present invention to provide a massaging device for eliminating fat in the human body, which overcomes the drawbacks of the conventional massaging device, and is suitable for everyone.

An aspect of the present invention is to provide a massaging structure to eliminate fat comprising a substantially T-shaped hold body, a rotating motor, a bowl-shaped seat body, a massaging wheel seat, and a netlike cap, characterized in that the rotating motor is located within the hold body, and two speed-reducing wheel bodies and a connection ring body are positioned within an engaging slot located at the front end of the motor, a substantially circular hole is provided between the speed- reducing wheel bodies for the mounting of the rotating shaft of the rotating motor, when the rotating motor rotates, the speed-reducing motor drives a gear slot located at the other side of the speed-reducing motor to rotate, a gear protrusion body is mounted to one speed-reducing wheel body, and the front engaging slot is positioned with the seat body and the seat body is engaged at the engaging slot by means of screws, the massaging wheel seat is mounted at the front of seat body, and the bottom of the massaging seat is mounted with a plurality of wheel seats, and the massaging wheel is mounted to the wheel seat of the massaging wheel seat by a peg body, the front end of the T-shaped hold body is mounted with the netlike cap such that when the massaging wheel seat rotates the massaging wheel contact with the human body, and a control switch is provided to a power source wire connected to the massaging device, thereby the operation of the motor will massage the body which in contact with the netlike cap.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
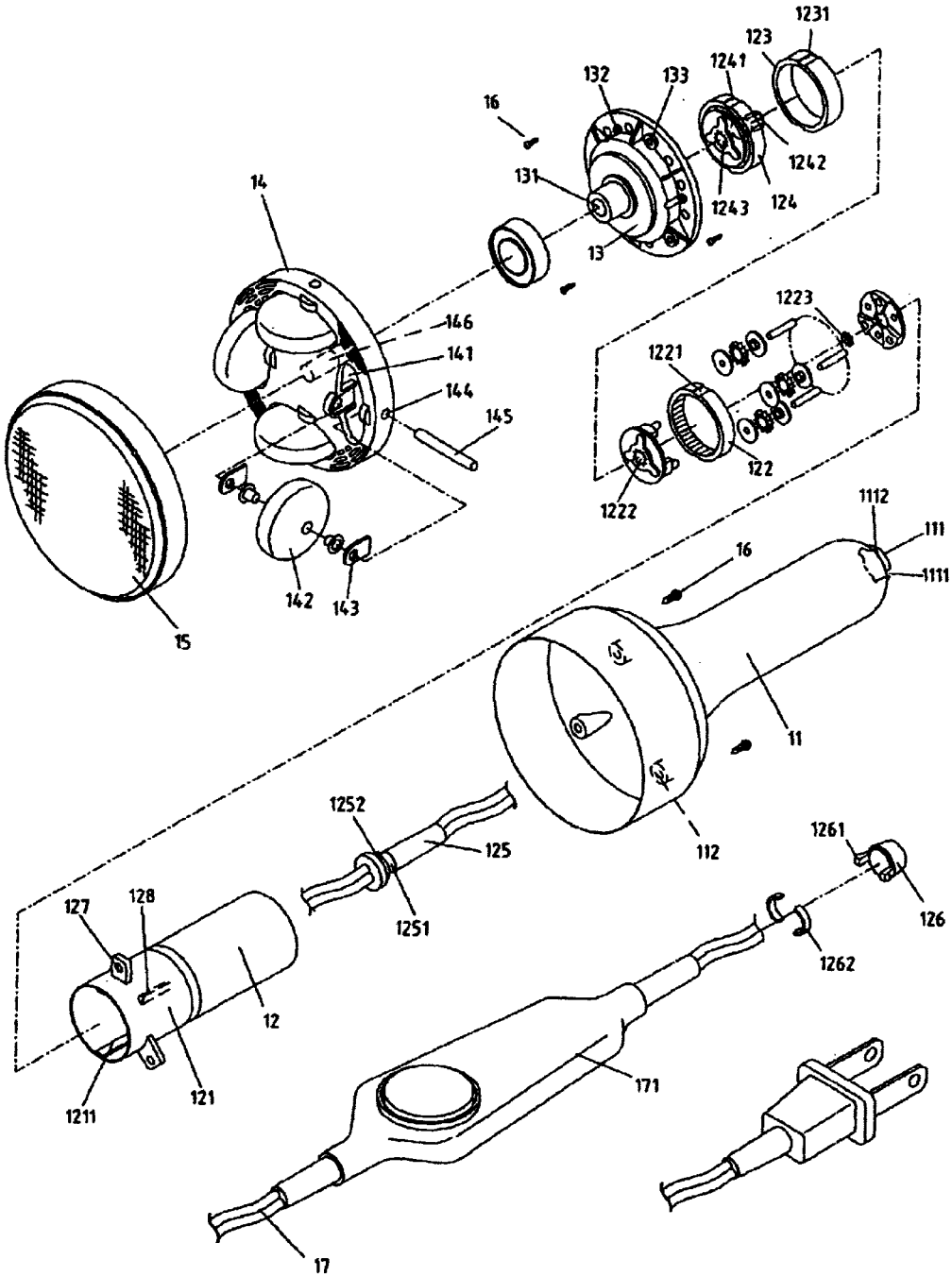
FIG. 1 a perspective exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
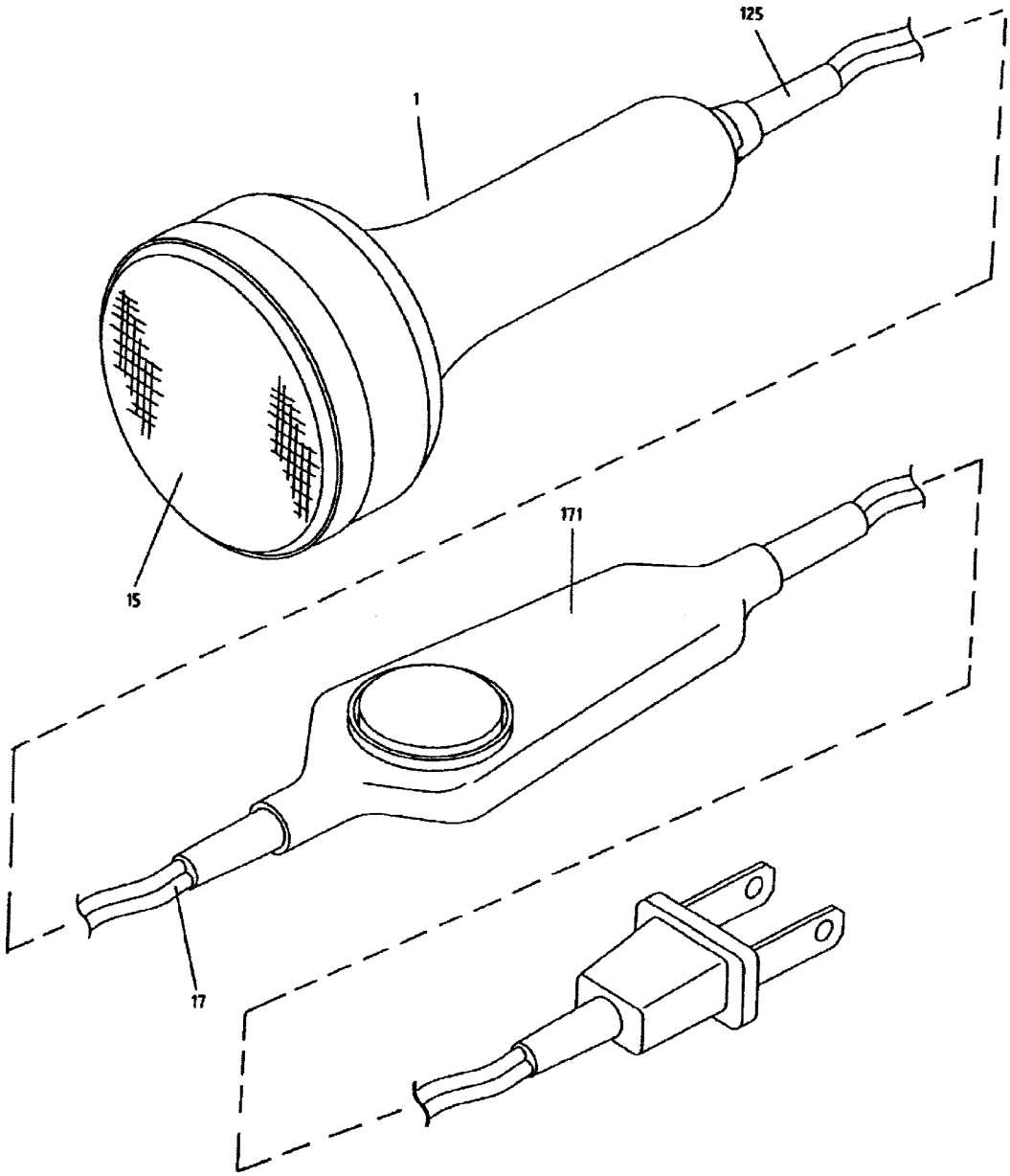
FIG. 2 is a perspective view of the present invention.
Figure 3:
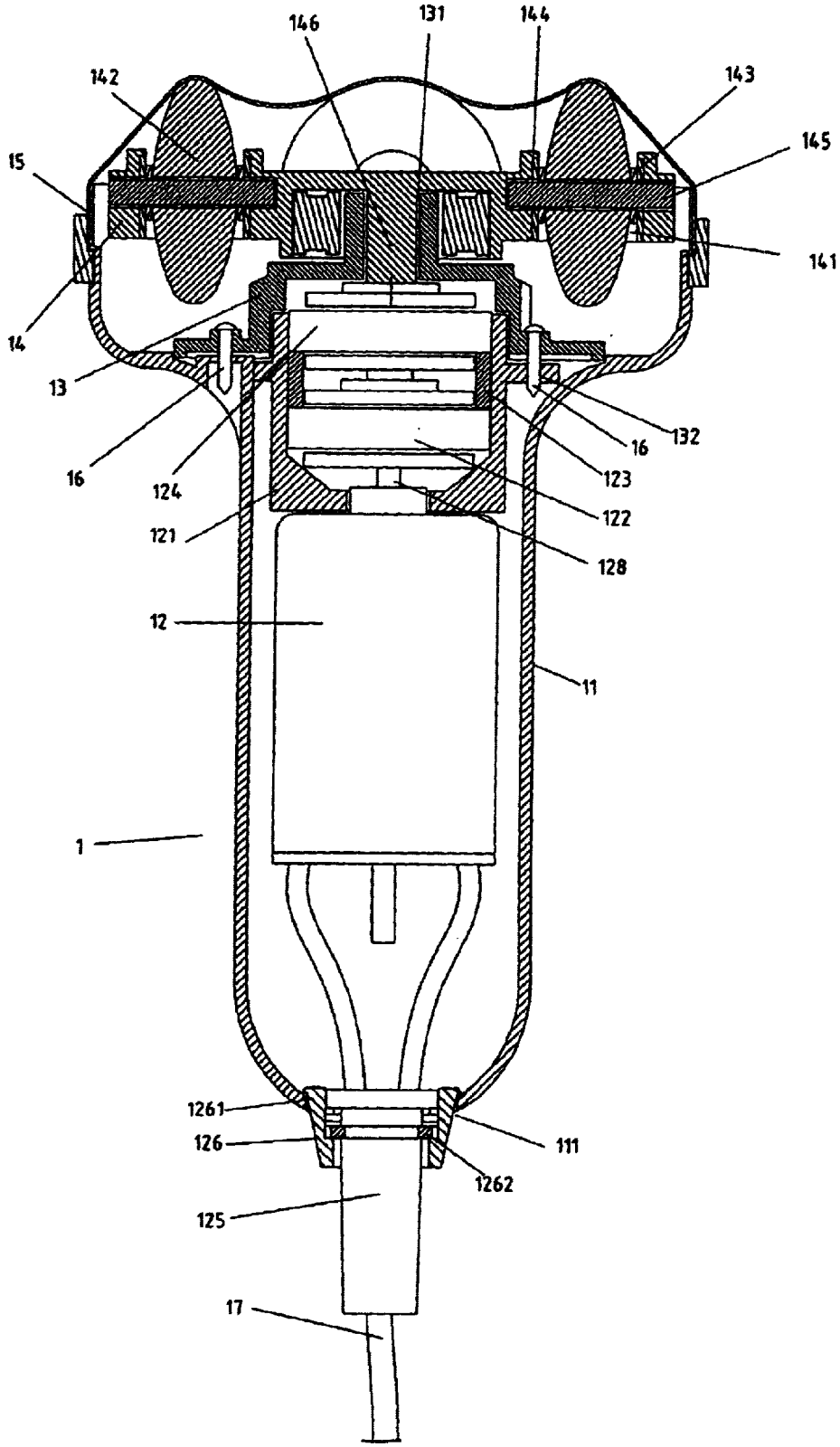
FIG. 3 is a sectional view of the present invention.
Figure 4:
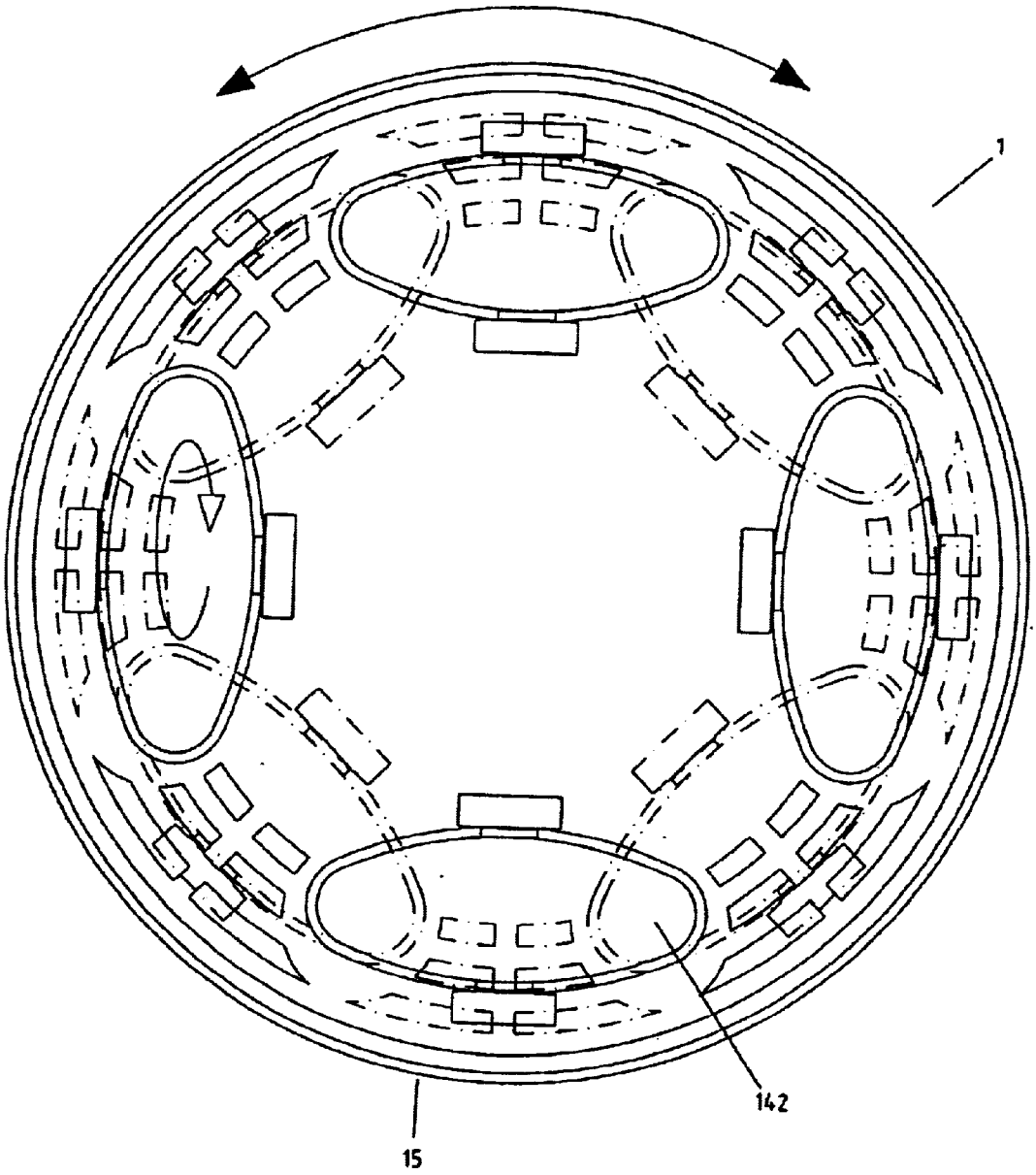
FIG. 4 is a schematic view showing the action of the massaging device of the present invention.

Referring to FIGS. 1 to 4, there is shown a massaging device generally comprising a substantially T-shaped hold body 1, a rotating motor 12 contained within the hold body 1, a bowl-shaped seat body 13, a massaging wheel seat 14, a netlike body 15. The front end of the motor 12 is provided with an engaging slot 121 having two protruded rids 1211 at the inner wall thereof The engaging slot 121 can be fitted with two speed-reducing wheel bodies 122, 124 and a hollow connection ring body 123. At the external ring edges of the speed-reducing wheel bodies 122, 124 and the connection ring body 123 a plurality of rid slots 1221, 1231, 1241 are provided and the rid slots 1221, 1231, and 1241 are corresponding to the protruded rid 1211 located at the engaging slot 121. The speed-reducing wheel body 122, 124 and the connection ring body 123 can be fitted onto the engaging slot 121. A circular hole 1223 is provided at the center of the speed reducing wheel body 122 to allow the rotating shaft 128 of the rotating motor 12 to be inserted therein.

When the rotating motor 12 rotates the speed-reducing wheel body 122 and in turn, drives the gear slot 1222 at the other side of the speed-reducing wheel to rotate. The connection ring body 123 is located between the two speed-reducing wheel bodies 122, 124. At the center of the speed-reducing wheel body 124, corresponding to the gear slot 1222, a gear protrusion body 1242 is provided so as to cause the gear protrusion body 1242 to engage with the gear slot 1222. On the other side of the speed-reducing wheel body 124, another gear slot 1243 is provided, and the front end of the engaging slot 121, the bowl-shaped seat body 13 is engaged thereto. A plurality of through holes 127 are provided at the external ring of the engaging slot 121 and the holes 127 are corresponding to the screw holes 132 provided on the bowl-shaped seat body 13. The seat body 13 is positioned on the engaging slot 121 by means of screws 16. The center of the seat body 13 is provided with a through hole 131 for the mounting of the gear protrusion body 146 at the center of the massaging wheel seat 14. A plurality of screw holes 133 are provided on the external ring of the seat body 13 and the screw holes 133 are corresponding to the screw holes 112 at the neck portion of the hold body 11, and a plurality of screws 16 are used to lock the seat body 13 onto the hold body 11. A massaging wheel seat 14 is positioned at the front end of the seat body 13 and a plurality of wheel seats 141 are provided in clockwise direction along the massaging wheel seat 14. The size of the wheel seat 141 is the size that can be engaged with the massaging wheel 142. At the side of the wheel seat 141, a block plate 143 is provided and a peg hole 144 is provided to the center of the wheel seat 141. By means of the block plate 143, the massaging wheel 142 can be engaged onto the wheel seat 141 without wear, and a peg body 145 passed through the peg hole 144 mounts the massaging wheel 142 onto the wheel seat 141 of the massaging wheel seat 14.

The center of the massaging seat 14 is provided with a gear protrusion body 146. The gear protrusion body 146 is passed through the through hole 31 and is engaged at the gear slot 1243 of the speed-reducing wheel body 124. The netlike body 15 is mounted at the front end of the hold body 11. If the massaging wheel seat 14 rotates, the massaging wheel 142 is in contact with the human body to provide massaging function. At the rear end of the hold body 11, a wire outlet 111 is provided, and on the outlet 111, a corresponding engaging recess 1111 and positioning recess 1112 are provided.

The wire connector 125 at the end of the rotating motor 12 is mounted at the positioning recess 1112 of the wire outlet 111. On the wire connector 125, a groove 1251 is provided and is for the mounting of a circular block 1262. An engaging body 126 has an engaging block 1261 being used to mount at the engaging recess 1111 at the wire outlet 111. The wire connector 125 is engaged at the wire outlet 111 of the hold body 11 and a power source wire 17 is then connected. A controller 171 is provided at an appropriate section on the power source wire 17 so as to control the ON/OFF of the massaging device and the strength of massaging effect, such as strong, medium and weak.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A massaging structure for eliminating fat comprising a bold body, a rotating motor, a bowl-shaped seat body, a massaging wheel seat including a plurality of seats, a plurality of massaging wheels being mounted on the respective seats, a net-type cap for covering the wheels, a first and a second speed-reducing wheel bodies, a connection ring body, a circular hole element being located between the first speed-reducing wheel body and the rotating shaft for mounting the first speed-reducing wheel body onto the rotating shaft, a control switch, and a power source connected to the massaging structure;

wherein said rotating motor having a rotating shaft located in a front end of the rotating motor, an engaging slot being positioned at the front end of said rotating motor, and said rotating motor and engaging slot being located within the hold body;

said speed-reducing wheel bodies and said connecting ring body being positioned within said engaging slot;

wherein each of the speed-reducing wheel bodies having a gear slot; a gear protrusion body being mounted to the second speed-reducing wheel body;

said seat body being positioned on the engaging slot by screws;

said massaging wheel scat being mounted at a front side of the seat body; each of said wheels being mounted to a respective seat by a peg body;

said hold body having an end, said end of said hold body being mounted to the net-like cap; and wherein rotation of the rotating shaft rotating the massaging wheel seat along with the wheels such that human body part in contact with the cap can be massaged by the wheels.

* * * * *